US008249776B2

(12) United States Patent
Reimann et al.

(10) Patent No.: US 8,249,776 B2
(45) Date of Patent: Aug. 21, 2012

(54) METHOD FOR CONTROLLING AN ACTIVE RUNNING GEAR OF A RAIL VEHICLE

(75) Inventors: Uwe Reimann, Siegen (DE); Alfred Lohmann, Siegen-Eisern (DE); Jani Dede, Siegen (DE)

(73) Assignee: Bombardier Transportation GmbH, Berlin (DE)

( * ) Notice: Subject to any disclaimer, the term of this patent is extended or adjusted under 35 U.S.C. 154(b) by 658 days.

(21) Appl. No.: 12/301,335

(22) PCT Filed: Apr. 16, 2007

(86) PCT No.: PCT/EP2007/053688

§ 371 (c)(1),
(2), (4) Date: Apr. 29, 2009

(87) PCT Pub. No.: WO2007/137906

PCT Pub. Date: Dec. 6, 2007

(65) Prior Publication Data

US 2009/0276107 A1 Nov. 5, 2009

(30) Foreign Application Priority Data

May 31, 2006 (DE) ..... 10 2006 025 773

(51) Int. Cl.
*G06F 7/00* (2006.01)

(52) U.S. Cl. ..... 701/41; 701/19; 701/72

(58) Field of Classification Search ..... 701/19, 701/41, 42, 43, 44, 72; 105/165, 168, 166, 105/167, 174, 199.1, 199.2
See application file for complete search history.

(56) References Cited

U.S. PATENT DOCUMENTS

| | | | | |
|---|---|---|---|---|
| 6,418,858 | B1 | 7/2002 | Hentschel et al. | |
| 6,571,178 | B1 | 5/2003 | Koch et al. | |
| 7,458,324 | B2 | 12/2008 | Schneider et al. | |
| 2005/0103223 | A1 * | 5/2005 | Schneider et al. | 105/168 |

FOREIGN PATENT DOCUMENTS

| | | | |
|---|---|---|---|
| DE | 4040303 | A1 | 6/1992 |
| DE | 4412951 | C1 | 5/1995 |
| DE | 4412952 | C1 | 5/1995 |
| DE | 19826452 | A1 | 12/1999 |
| DE | 19861086 | A1 | 1/2000 |
| DE | 10137443 | A1 | 3/2003 |

* cited by examiner

*Primary Examiner* — Mark Le
(74) *Attorney, Agent, or Firm* — The Webb Law Firm

(57) ABSTRACT

A method for controlling an active running gear of a rail vehicle including at least one first wheel unit with two wheels, wherein by means of at least one first actuator, which acts between the first wheel unit and a vehicle structure supported thereon by means of a first primary spring mechanism, the turning angle of the first wheel unit about a vertical running gear axis relative to the vehicle structure is adjusted, in a first frequency range, as a function of the actual curvature of the track and/or the turning angle of the first wheel unit about a vertical running gear axis relative to the vehicle structure is adjusted, in a second frequency range, such that transversal movements at least of the first wheel unit, caused by track outlay disturbances or by a sinusoidal course, are counteracted.

28 Claims, 2 Drawing Sheets

METHOD FOR CONTROLLING AN ACTIVE RUNNING GEAR OF A RAIL VEHICLE

BACKGROUND OF THE INVENTION

1. Field of the Invention

The present invention relates to a method for controlling an active running gear of a rail vehicle, and also relates to a device for controlling an active running gear of a rail vehicle as well as to a rail vehicle equipped with a device according to the invention.

2. Description of Related Art

Running gear of rail vehicles are normally subject to a conflict of aims between track stability at high running speeds on straight sections and good curve compliance characteristics on curved sections. Track stability at high running speeds on straight sections requires rigid longitudinal guidance of the wheel units (wheel sets or wheel pairs) while good curve compliance characteristics require curve-radial adjustment of the wheel units and thus soft longitudinal guidance. With respect to known solutions in standard gauge railways, rail vehicles with good curve compliance characteristics therefore usually have a stability-governed maximum speed, which is substantially less than in the case of high-speed trains, which are designed for distances with few curves or such with very wide curve radii. The running gear of high-speed trains in turn are not very curve friendly. Passive solutions obviously can always only reach a compromise between these two conflicting requirements.

Furthermore, in the case of very tight track curves as they occur, for example, in tram networks the ability of the wheel units to self-adjust to curve-radii fails for physical reasons. In order to overcome this disadvantage, German Patent DE 198 61 086 A1 for example proposes an active system for adjusting the wheel sets by the radius of curvature, which however cannot make any contribution to stabilizing running at high speeds—not arising at all in tramway operations anyway.

In contrast to this a solution is known from DE 101 37 443 A1 eliminating the conflicting aims described above. An active controlling method and a corresponding device, which achieves optimized operating characteristics for both objects, are described for a running gear with wheel sets guideably attached to the bogie frame. Thus, by control in a first, preferably lower frequency range, adjustment of the wheel sets in accordance with the curvature of the track present in the curve is achieved, while in a second preferably higher frequency range the reaction to track outlay disturbances is compensated and the onset of instability is prevented.

Both with respect to the input quantities used for the control and also the control of the actuator adjusting the wheel sets as well as its working principle and arrangement in the running gear of the rail vehicle, DE 101 37 443 A1 indicates a series of alternative embodiments, which all achieve the object aimed at.

A disadvantage of this control however lies in the fact that because of adherence to the ideal line when running on the track a very sharply defined wear pattern can develop comparatively quickly on the wheels, as a result of which the service life of the wheels can be substantially reduced.

SUMMARY OF THE INVENTION

It is thus the object of the present invention to provide a method and a device of the type initially specified which do not have the disadvantages mentioned above or at least to a lesser extent and, particularly, in a simple and reliable way enable the wear behaviour of the wheels to be improved.

The present invention is based on the technical teaching that improvement in the wear behaviour of the wheels can be achieved in a simple and reliable way if a target value, which corresponds to an ideal target value multiplied by a pre-defined correction factor, is used in the respective frequency range for the control. By means of the correction factor it is then possible in a controlled way to detune the control relative to the ideal control, which is very prone to causing local wear on the wheels, without having to forfeit the advantages of the ideal control. It has been shown that even with minor, defined deviations from the ideal control, still with good curve compliance characteristics and good stabilization on straight sections, a substantially better distribution of the wear on wheel contact surfaces can be achieved resulting in a considerably more favourable wear pattern and thus longer service life.

In this case it can be provided that the ideal control is implemented possibly even over longer distances, i.e. the relevant correction factor is selected equal to one, and only occasionally the control is defined so as to be detuned relative to the ideal control, i.e. the relevant correction factor is selected unequal to one. Furthermore it can be provided that detuning of the control relative to the ideal control by means of the correction factor is altered according to a pre-defined time scheme, for example constantly. As a result arbitrary wear distributions can be achieved.

The adjusting movements in the two frequency ranges can be superimposed in the known way, possibly being applied on the respective wheel unit by a single actuator.

It is thus provided according to the invention that the turning angle of the first wheel unit is adjusted in the first frequency range using a first target value, which corresponds to a first ideal target value multiplied by a pre-defined first correction factor ($K_1$), wherein the first ideal target value is selected such that, if the first target value matches the first ideal target value (i.e. $K_1=1$) corresponding to the actual curvature of the track, the first wheel unit is adjusted at least approximately curve-radially. Additionally or alternatively it is provided that the turning angle of the first wheel unit is adjusted in the second frequency range using a second target value, which corresponds to a second ideal target value multiplied by a pre-defined second correction factor ($K_2$), wherein the first ideal target value is selected such that, if the first target value matches the first ideal target value (i.e. $K_1=1$), transversal movements at least of the first wheel unit caused by track outlay disturbances or by a sinusoidal course are essentially compensated.

Preferably if the first target value matches the first desired ideal target value in the case of the actual curvature of the track, the first wheel unit is adjusted exactly curve-radial and the resetting turning moment of the first primary spring mechanism is substantially in equilibrium with the turning moment resulting from the wheel rail pairing, so that the at least one first actuator momentarily essentially must not apply any turning moment.

In other words, when negotiating a curve, it is preferably permitted that, in the first frequency range, the actuator follows the excursion movement of the wheel unit due to the track curvature, until as in the case of a passive curve-friendly running gear the wheel unit is adjusted to be at least approximately curve-radial. As a result, measurement or other calculation of the actual track curvature can possibly be omitted, and it can eventually be established that the wheel unit is adjusted curve-radially only on the basis of the load present in the actuator in the first frequency range, or conclusions on the turning angle necessary for exact curve-radial adjustment can be drawn on the basis of the parameters of the running gear and the actual running state (speed, transversal acceleration etc.). This has the advantage that compared with a usually more or less complex calculation of the actual curvature of the track a substantially shorter time delay in the adjustment can be achieved.

It is remarked here that this permitting or following, respectively, of the passive excursion movement of the wheel unit represents a standalone patentable inventive concept which is independent of the use of the correction factors.

In the preferred variants of the method according to the invention it is provided that the at least one first actuator is adjusted in the first frequency range to follow a turning movement of the first wheel unit caused by a change in the curvature of the track such that, if the first target value matches the first ideal target value corresponding to the actual curvature of the track, the at least one first actuator, in the first frequency range, momentarily essentially does not apply any turning moment.

For the first frequency range, i.e. the adjustment of the turning angle to the curve negotiation, the control concept is based on balancing the turning moments (or force couples) acting on the respective wheel unit about a vertical running gear axis upon curve-radial adjustment of the wheel unit. This is calculated as follows:

$$M_{Tx}+M_{cxp}+M_{Akt}=0, \tag{1}$$

wherein:

- $M_{Tx}$: Turning moment from the force couples (for example force couple of the longitudinal slip forces) resulting from the wheel rail pairing at both points of wheel contact;
- $M_{cxp}$: Turning moment from the resetting forces of the primary spring mechanism;
- $M_{Akt}$: Turning moment from the components of the adjusting forces of the actuator in the first frequency range.

When adjusting the first actuator with the freedom from load ($M_{Akt}=0$) at the first ideal target value, as it has just been described, the result of equation (1) is as follows:

$$M_{Tx}=-M_{cxp}. \tag{2}$$

This variant of the control according to the invention ultimately means that the turning moment from the resetting forces of the primary spring mechanism compensates the turning moment resulting from the wheel rail pairing, as this is the case with a passive curve-friendly running gear (without an actuator). Here in other words a passive curve-friendly running gear is simulated, wherein in an advantageous way only minimum energy consumption is possibly required at the actuator for the excursion from the respective position, differently than for a method with active adjustment of the turning angle as a function of the track curvature. If necessary the actuator is taken along to the respective position only approximately free of load. While passive curve-friendly running gear however only have limited stability because of the reduced longitudinal rigidity of the wheel set guidance, this disadvantage is eliminated with the active control according to the invention.

The first target value used in the control can be detuned relative to the first ideal target value by means of the first correction factor $K_1$. Thus as mentioned, over- or under-compensation can also be achieved, which however is associated with energy consumption and therefore $M_{Akt}\neq 0$ results. Where $K_1=0$, for example, rigid wheel set guidance can even be realized as in the case of the conventional passive vehicle.

In this case, the actuator may, intermittently or continuously, be provided with a new ideal target value to for its excursion with which the freedom from load to be achieved is then reached. In other words, the ideal target value can be adjusted intermittently or continuously to follow the excursion movement and, thus, the actual track curvature. Any arbitrary quantity representative of the freedom from load of the actuator can be used as a reference quantity for adjusting the ideal target value. Thus, this quantity is preferably selected as a function of the measurement principle with which the load on the actuator is determined.

The first ideal target value can be adjusted according to the curvature of the track in any arbitrary suitable way. Preferably, the turning angle of the first wheel unit and a quantity representative of the load on the actuator are captured (for example, a force value, a moment value, a pressure value, an electrical current value etc.). A corresponding new first ideal target value is pre-determined if the load on the actuator deviates from zero. This can take place intermittently or continuously wherein, for example, via temporary integration of the quantity representative of the load on the actuator, it can be guaranteed that only the load situation on the actuator in the first frequency range is captured.

The first ideal target value may be any suitable quantity by means of which the desired adjustment of the wheel unit can be achieved. In particular a quantity which is representative of the freedom from load of the actuator can also be directly used as the case may be. Preferably the first ideal target value is a first ideal target turning angle ($\phi_{z1si}$), which is adjusted to the curvature of the track.

As already mentioned above, it can be provided that the first correction factor ($K_1$) at least occasionally is selected unequal to one in order to achieve distribution of the wear over the wheel contact surfaces. Additionally or alternatively it can be provided that the first correction factor ($K_1$) at least occasionally is selected equal to one in order to achieve, during this period, a travel performance which is at least approximate to the ideal line. Equally, it may be additionally or alternatively provided that the first correction factor ($K_1$) is varied according to a pre-defined scheme, wherein, in particular, continuous variation is possible in order to achieve favourable wear distribution.

The above-described control can take place in a preferred first variant of the method according to the invention for all wheel units of the running gear, so that, for all of them, curve negotiating characteristics as with a passive curve-friendly running gear can be ultimately simulated. As is evident, in particular, from equation (1) with this control the ideal concept of curve compliance with $M_{Tx}=0$ (i.e. without turning moment resulting from the wheel rail pairing) and with balanced curve-radial transversal track forces is not reached, but very good curve compliance and wear characteristics can be achieved with high attainable track stability and very little energy consumption.

For example, in the case of a typical rail vehicle having a vehicle body supported on two running gears each having two wheel units by means of a secondary spring mechanism, the sum of the curve-radial lateral transversal track forces can be calculated as follows for the running gear leading in the travel direction:

$$\sum Y_1 = \frac{F_{aq}}{2} + \frac{M_{cxs}}{2a} - \frac{(M_{Tx1}+M_{Tx2})}{2a} \tag{3}$$

$$\sum Y_2 = \frac{F_{aq}}{2} - \frac{M_{cxs}}{2a} + \frac{(M_{Tx1}+M_{Tx2})}{2a} \tag{4}$$

and for the running gear trailing in the travel direction:

$$\sum Y_1 = \frac{F_{aq}}{2} - \frac{M_{cxs}}{2a} - \frac{(M_{Tx1} + M_{Tx2})}{2a} \tag{5}$$

$$\sum Y_2 = \frac{F_{aq}}{2} + \frac{M_{cxs}}{2a} + \frac{(M_{Tx1} + M_{Tx2})}{2a} \tag{6}$$

wherein:

- $\Sigma Y_1$: Sum of the lateral track forces on the respective wheel unit leading in the travel direction;
- $\Sigma Y_1$: Sum of the lateral track forces on the respective wheel unit trailing in the travel direction;
- $F_{aq}$: Centrifugal force, which acts on the rail vehicle;
- $M_{Tx1}$: Turning moment from the wheel rail pairing on the respective wheel unit leading in the travel direction;
- $M_{Tx2}$: Turning moment from the wheel rail pairing on the respective wheel unit trailing in the travel direction;
- $M_{cxs}$: Turning moment from the resetting forces of the respective secondary spring mechanism;
- 2a: Axial distance of the wheel units on the respective running gear.

It has turned out that improvement relative to the passively radially adjustable curve negotiating ($M_{Akt}=0$ and $M_{Tx}=-M_{cxp}$) is only possible with considerable energy consumption at the actuator ($M_{Akt}>>0$) in order to come close to the ideal concept of curve negotiating (where $M_{Tx}=0$ and $\Sigma Y_1=\Sigma Y_2$). However, with the variant of the method according to the invention described below, it is possible, through correspondingly reduced energy consumption, to achieve good approximation to the ideal curve negotiation.

Thus, in a preferred second variant of the method according to the invention, it is provided that the running gear comprises a second wheel unit with two wheels trailing the first wheel unit, on which the vehicle structure is supported by means of a second primary spring mechanism. The turning angle of the second wheel unit is adjusted by means of at least one second actuator acting between the second wheel unit and the vehicle structure. While the turning angle of the first wheel unit is adjusted in accordance with the above first variant (i.e. $M_{Akt}=0$), the turning angle of the second wheel unit is adjusted in the first frequency range using a third target value, which corresponds to a third ideal target value multiplied by a pre-defined third correction factor ($K_3$). In this case the third ideal target value is selected such that, if the third target value matches the third ideal target value (i.e. $K_3=1$), the turning moment on the first wheel unit resulting at the actual curvature of the track from the wheel rail pairing is inversely equal to the turning moment on the second wheel unit resulting at the actual curvature of the track from the second wheel rail pairing (i.e. $M_{Tx1}=-M_{Tx2}$).

From the equations (3) to (6) the following applies:

$$\sum Y_1 = \frac{F_{aq}}{2} \pm \frac{M_{cxs}}{2a}, \tag{7}$$

$$\sum Y_2 = \frac{F_{aq}}{2} \mp \frac{M_{cxs}}{2a}. \tag{8}$$

In other words it is hereby achieved that the sums of the lateral track forces $\Sigma Y_1$ and $\Sigma Y_2$ are balanced apart from the component of the resetting forces of the respective secondary spring mechanism.

The third ideal target value again may be any suitable quantity by means of which the desired adjustment of the wheel unit can be achieved. Preferably the third ideal target value is a third ideal target turning angle ($\phi_{z3si}$) which is preferably calculated from the turning moment ($M_{Tx1}$) resulting at the actual curvature of the track from the wheel rail pairing on the first wheel unit, from a running gear specific dependence of the turning moment ($M_{cxp2}$) of the second primary spring mechanism on the turning angle ($\phi_{Z3}$) of the second wheel unit and from a running gear specific dependence of the turning moment ($M_{Akt2}$) of the second actuator on the turning angle ($\phi_{Z3}$) of the second wheel unit. Such dependence of the turning moment ($M_{Akt2}$) of the second actuator on the turning angle ($\phi_{Z3}$) of the second wheel unit can be pre-determined in any arbitrary way, for example, by a pre-defined equation, a characteristic line or a characteristic map etc. which has been determined for the vehicle in advance.

Here as well, an arbitrary, possibly time-dependent detuning of the third target value used can be achieved in relation to the third ideal target value by means of the third correction factor ($K_3$). Thus the third correction factor ($K_3$), similarly to the first correction factor ($K_1$), at least occasionally can be selected unequal to one and/or at least occasionally selected equal to one and/or varied according to a predefined sequence.

In a preferred third variant of the method according to the invention it is provided that the at least one first actuator is adjusted in the first frequency range to follow a turning movement of the first wheel unit caused by a change in the curvature of the track such that, if the first target value matches the first ideal target value at the actual curvature of the track, the at least one first actuator in the first frequency range momentarily applies a turning moment which is inversely equal to the turning moment of the first primary spring mechanism (i.e. $M_{Akt1}=-M_{cxp1}$).

In a preferred further embodiment of the third variant of the method according to the invention the running gear has a second wheel unit with two wheels trailing the first wheel unit, on which the vehicle structure is supported by means of a second primary spring mechanism, and the turning angle of the second wheel unit is adjusted by means of at least one second actuator acting between the second wheel unit and the vehicle structure. Here it is provided that also the second wheel unit is controlled according to this third variant. The turning angle of the second wheel unit is therefore adjusted in the first frequency range using a third target value, which corresponds to a third ideal target value multiplied by a pre-defined third correction factor ($K_3$). The third ideal target value is again selected such that if the third target value matches the third ideal target value (i.e. $K_3=1$) the at least one second actuator is adjusted in the first frequency range to follow a turning movement of the second wheel unit caused by a change in the curvature of the track such that the at least one second actuator at the actual curvature of the track in the first frequency range momentarily applies a turning moment which is inversely equal to the turning moment of the second primary spring mechanism (i.e. $M_{Akt2}=-M_{cxp2}$).

Thus, here again, upon curve-radial adjustment of the first wheel unit, disappearance of the turning moment from the wheel rail pairing (i.e. $M_{Tx2}=0$) results from equation (1) and from equations (3) to (6):

$$\sum Y_1 = \frac{F_{aq}}{2} \pm \frac{M_{cxs}}{2a}, \tag{7}$$

-continued $$\sum Y_2 = \frac{F_{aq}}{2} \mp \frac{M_{cxs}}{2a}. \tag{8}$$

in other words hereby it is achieved as well that the sums of the lateral track forces $\Sigma Y_1$ and $\Sigma Y_2$ are balanced apart from the component of the resetting forces of the respective secondary spring mechanism.

The first and/or third ideal target value again may be any suitable quantity by means of which the desired adjustment of the wheel unit concerned can be achieved. Preferably here as well, the first and/or third ideal target value is a first and/or third ideal target turning angle ($\phi_{z1si}$, $\phi_{z3si}$), which is adjusted to follow the curvature of the track.

The first ideal target value or the first ideal target turning angle ($\phi_{z1i}$) can be adjusted to follow the curvature of the track in any arbitrary suitable way. Preferably the turning angle of the first wheel unit and a quantity representative of the load on the actuator (for example a force value, a moment value, a pressure value, an electric current value etc.) are captured. A new first ideal target value or ideal target turning angle ($\phi_{z1i}$) is pre-defined if the load on the actuator deviates from the one resulting from the resetting moment of the primary spring mechanism at this turning angle.

Here as well, in relation to the first ideal target value, an arbitrary, possibly time-dependent, driving-situation-dependent and/or track-situation-dependent detuning of the first target value used can be achieved by means of the first correction factor ($K_1$) as described above. Thus, the first correction factor ($K_1$) at least occasionally can be selected unequal to one and/or at least occasionally selected equal to one and/or varied according to a pre-defined scheme.

In a preferred fourth or fifth variant of the method according to the invention the running gear has a second wheel unit with two wheels trailing the first wheel unit, on which the vehicle structure is supported by means of a second primary spring mechanism, and the turning angle of the second wheel unit is adjusted by means of at least one second actuator acting between the second wheel unit and the vehicle structure. Furthermore the vehicle structure is supported on the first wheel unit and the second wheel unit by means of a secondary spring mechanism. Here it is provided that the first wheel unit is controlled according to the above first variant ($M_{Akt}=0$) or third variant ($M_{Akt1}=-M_{cxp1}$), while the turning angle of the second wheel unit is adjusted in the first frequency range using a third target value which corresponds to a third ideal target value multiplied by a pre-defined third correction factor ($K_3$). The third ideal target value in this case is selected such that, if the third target value matches the third ideal target value (i.e. $K_3=1$), the turning moment on the second wheel unit resulting at the actual curvature of the track from the wheel rail pairing corresponds to the turning moment difference which results from the product of a travel direction factor (L) with the actual resetting turning moment present from the secondary spring mechanism and the amount of the turning moment, resulting from the wheel rail pairing at the actual curvature of the track at the first wheel unit, wherein the travel direction factor (L) for a leading running gear is equal to 1 and for a trailing running gear is equal to −1 (i.e. $M_{Tx2}=M_{cxs}-M_{Tx1}$ for a leading running gear or $M_{Tx2}=-M_{cxs}-M_{Tx1}$ for a trailing running gear).

In the case of the fourth variant ($M_{Akt1}=0$ and $M_{Tx2}=\pm M_{cxs}-M_{Tx1}$) and in the case of the fifth variant ($M_{Akt1}=-M_{cxp1}$ and $M_{Tx2}=\pm M_{cxs}-M_{Tx1}$) the following results from the equations (3) to (6) in each case:

$$\sum Y_1 = \frac{F_{aq}}{2} \pm \frac{M_{cxs}}{2a} \mp \frac{M_{cxs}}{2a} = \frac{F_{aq}}{2}, \tag{9}$$

$$\sum Y_2 = \frac{F_{aq}}{2} \mp \frac{M_{cxs}}{2a} \pm \frac{M_{cxs}}{2a} = \frac{F_{aq}}{2}. \tag{10}$$

In other words it is also hereby achieved that the sums of the lateral track forces $\Sigma Y_1$ and $\Sigma Y_2$ are balanced (i.e. $\Sigma Y_1=\Sigma Y_2$).

Preferably the running gear in this case comprises a running gear frame, which is supported on the first wheel unit and the second wheel unit by means of a primary spring mechanism in each case, the vehicle structure being supported on the running gear frame by means of the secondary spring mechanism. In order to determine the resetting turning moment from the secondary spring mechanism, the turning angle between the running gear frame and the vehicle structure is determined.

The third ideal target value again may be any suitable quantity by means of which the desired adjustment of the second wheel unit can be achieved. Preferably, here as well, the third ideal target value is a third ideal target turning angle ($\phi_{z3si}$), which is adjusted to follow the curvature of the track.

Here again, an abritrary, possibly time-dependent detuning of the third target value used relative to the third ideal target value can be achieved by means of the third correction factor ($K_3$) as described above. Thus, the third correction factor ($K_3$) at least occasionally can be selected unequal to one and/or at least occasionally selected equal to one and/or varied according to a pre-defined sequence.

The first frequency range in principle can lie at any level suitably low for curve-radial adjustment of the wheel units. Preferably the first frequency range comprises 0 to 1 Hz, in particular 0 to 0.5 Hz.

The second frequency range, in principle, can lie at any level suitable for controlling the stability of the wheel units on straight sections but also on curved sections. Preferably the second frequency range at least partly lies above the first frequency range in order to permit simple separation between the two frequency ranges. Preferably, the second frequency range comprises 4 to 8 Hz.

In order to control the stability of the wheel units on straight sections but also on curved sections, preferably, it is provided that the momentary transversal speed of the first wheel unit as well as the momentary running speed of the rail vehicle is determined. A second ideal target turning angle ($\Phi_{z2s}$) is calculated for the second frequency range as the second ideal target value from the determined momentary transversal speed of the first wheel unit and the momentary running speed of the rail vehicle. In this case the second ideal target turning angle is selected such that, if a second target turning angle representing the second target value matches the second ideal target turning angle (i.e. $K_2=1$), a transversal speed of the first wheel unit is produced that is inversely equal to the calculated transversal speed of the first wheel unit. Thus in other words the resulting transversal speed of the wheel unit can be controlled to be zero.

Preferably, it is provided in this case that the momentary transversal speed of the first wheel unit is captured by means of a speed sensor or momentary transversal acceleration of the first wheel unit captured by an acceleration sensor is integrated to obtain the momentary transversal speed of the wheel set. Additionally or alternatively a running speed made available from a superordinate train control system is used as the momentary running speed of the rail vehicle. Additionally or alternatively the momentary running speed of the rail vehicle is determined by measuring the rotational speed of at least one wheel of the rail vehicle.

The present invention relates to a method for controlling an active running gear of a rail vehicle including at least one first wheel unit with two wheels, wherein by means of at least one first actuator, which acts between the first wheel unit and a vehicle structure supported thereon by means of a first primary spring mechanism, the turning angle of the first wheel unit about a vertical running gear axis relative to the vehicle structure is adjusted, in a first frequency range, as a function of the actual curvature of the track. Additionally or alternatively, the turning angle of the first wheel unit about a vertical running gear axis relative to the vehicle structure is adjusted, in a second frequency range, such that transversal movements at least of the first wheel unit, caused by track outlay disturbances or by a sinusoidal course, are counteracted. The turning angle of the first wheel unit is adjusted, in the first frequency range, using a first target value which corresponds to a first ideal target value multiplied by a pre-defined first correction factor ($K_1$), wherein the first ideal target value is selected such that, if the first target value matches the first ideal target value (i.e. $K_1=1$) at the actual curvature of the track, the first wheel unit is adjusted at least approximately curve-radially. Additionally or alternatively, the turning angle of the first wheel unit is adjusted, in the second frequency range, using a second target value which corresponds to a second ideal target value multiplied by a pre-defined second correction factor ($K_2$), wherein the second ideal target value is selected such that, if the second target value matches the second ideal target value (i.e. $K_2=1$), transversal movements at least of the first wheel unit caused by track outlay disturbances or by a sinusoidal course are essentially compensated.

Here again, also for the stability control, an arbitrary, possibly time-dependent detuning of the second target value used relative to the second ideal target value can be achieved by means of the second correction factor ($K_2$) as described above for the curve-radial adjustment. Thus, the second correction factor ($K_2$) at least occasionally can be selected unequal to one and/or at least occasionally selected equal to one and/or varied according to a pre-defined sequence.

The present invention also relates to a device for controlling an active running gear of a rail vehicle comprising at least one first wheel unit with two wheels, comprising a control unit and at least one first actuator controlled by a control unit, which acts between the first wheel unit and a vehicle structure supported thereon by means of a first primary spring mechanism. In this case the control unit, by means of the at least one first actuator, in a first frequency range adjusts the turning angle of the first wheel unit about a vertical running gear axis relative to the vehicle structure as a function of the actual curvature of the track. Additionally or alternatively the control unit, by means of the at least one first actuator, in a second frequency range counteracts transversal movements at least of the first wheel unit caused by track outlay disturbances or by a sinusoidal course. It is provided according to the invention that the control unit is configured such that the turning angle of the first wheel unit is adjusted in the first frequency range using a first target value which corresponds to a first ideal target value multiplied by a pre-defined first correction factor ($K_1$), wherein the first ideal target value is selected such that, if the first target value matches the first ideal target value (i.e. $K_1=1$) at the actual curvature of the track, the first wheel unit at least approximately is adjusted curve-radially. Additionally or alternatively it is provided according to the invention that the control unit is configured such that the turning angle of the first wheel unit is adjusted in the second frequency range using a second target value which corresponds to a second ideal target value multiplied by a pre-defined second correction factor ($K_2$), wherein the second ideal target value is selected such that, if the second target value matches the second ideal target value (i.e. $K_2=1$) transversal movements at least of the first wheel unit caused by track outlay disturbances or by a sinusoidal course are essentially compensated.

The device according to the invention is suitable for executing the method according to the invention. With the device according to the invention, the variants and advantages of the method according to the invention described above can be implemented to the same extent, so that here reference should be made to the above explanations.

The present invention also relates to a rail vehicle with an active running gear comprising at least one first wheel unit with two wheels and with a device according to the invention for controlling the active running gear. With the rail vehicle according to the invention as well the variants and advantages of the method according to the invention described above can be implemented to the same extent, so that likewise reference should be made to the above explanations.

Further preferred embodiments of the invention result from the dependent claims and the following description of preferred exemplary embodiments.

DETAILED DESCRIPTION OF THE INVENTION

Figure 2:
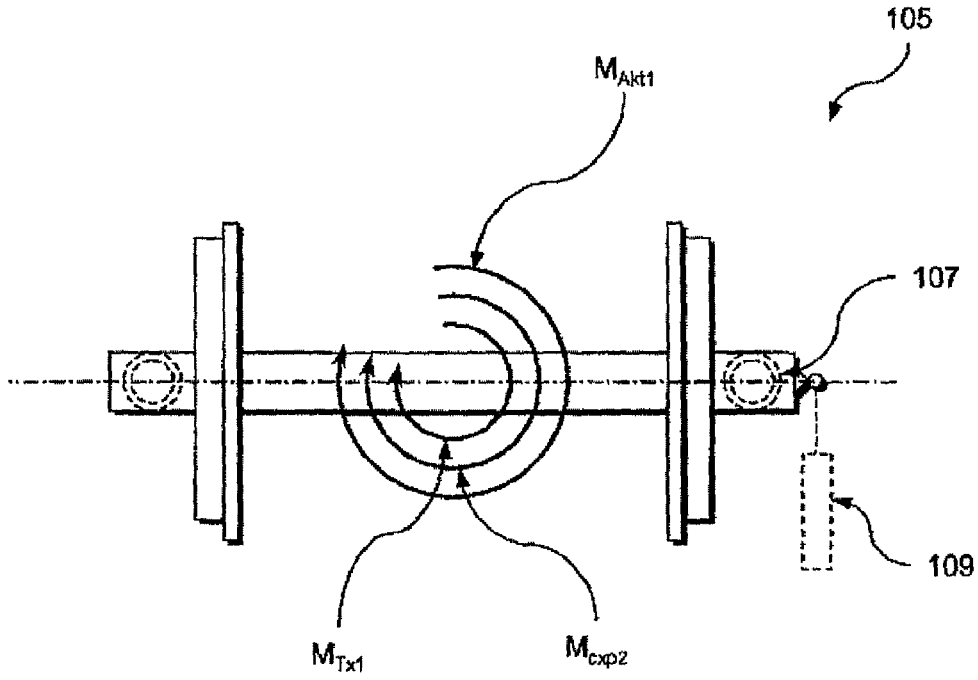
FIG. 2 shows a schematic view of a detail of the rail vehicle from FIG. 1 in order to explain the curve negotiation control in the first frequency range.
Figure 3:
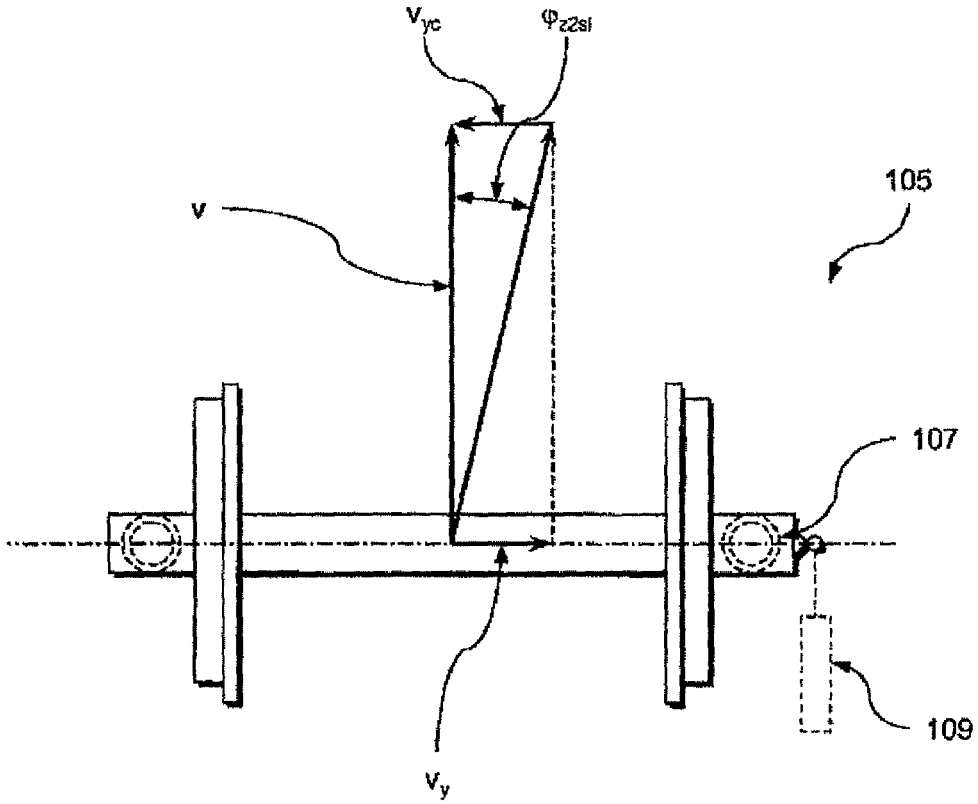
FIG. 3 shows a schematic view of a detail of the rail vehicle in order to explain the stability control in the second frequency range.

The present invention is described below on the basis of several exemplary embodiments of the method according to the invention, which in each case can be used with the rail vehicle of FIGS. 1 to 3.

Figure 1:
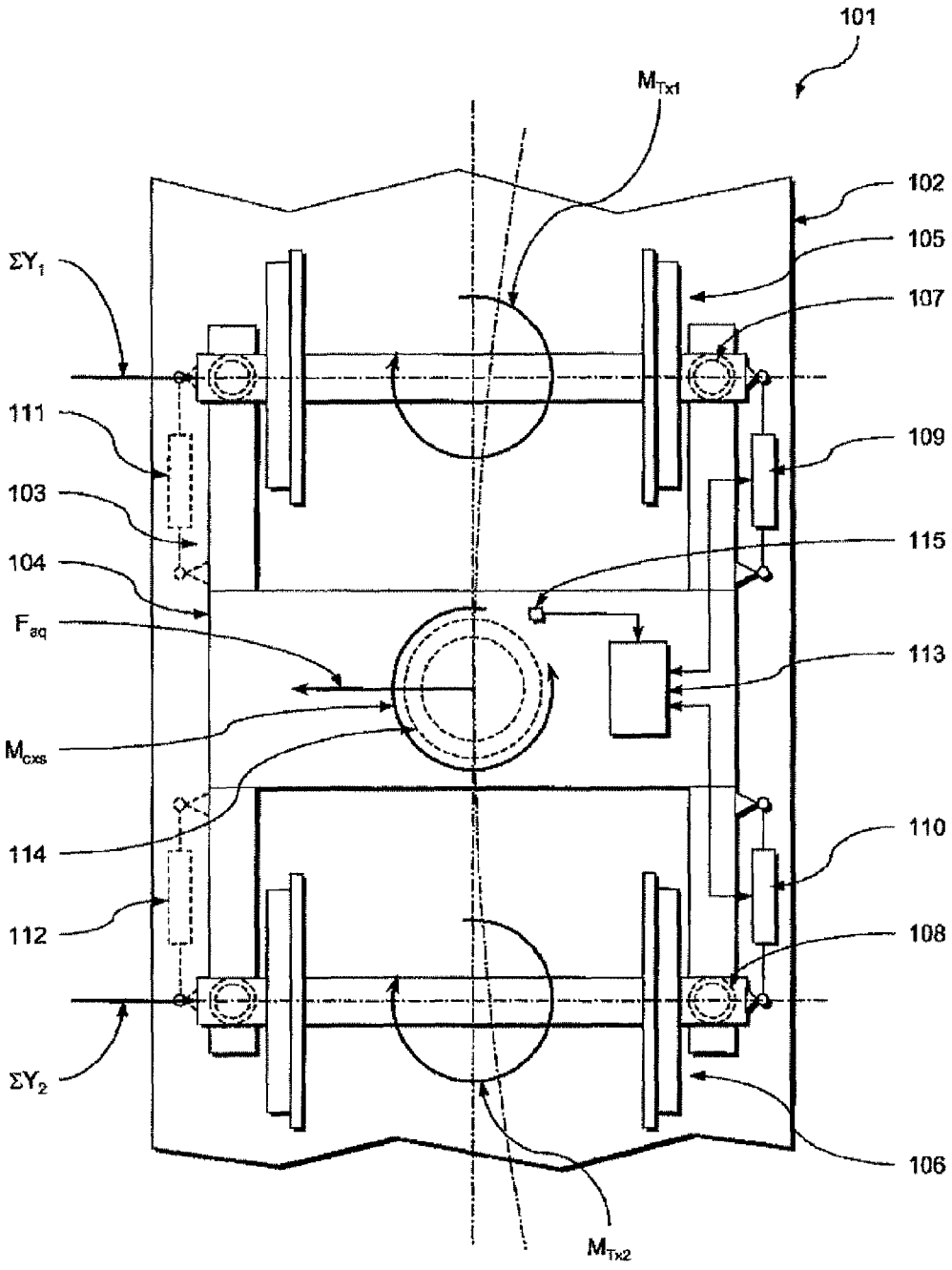
FIG. 1 shows a schematic view of part of a preferred embodiment of the rail vehicle according to the invention from below.

FIG. 1 shows—in a view from below, i.e. in the direction from the track—part of a rail vehicle 101 according to the invention with a carbody 102, which is supported on an active running gear in the form of a bogie 103. The bogie 103 comprises a bogie frame 104, a first wheel unit in the form of a first wheel set 105 and a second wheel unit in the form of a second wheel set 106. The bogie frame 104 in this case is supported on the first wheel set 105 by means of a first primary spring mechanism 107 and on the second wheel set 106 by means of a second primary spring mechanism 108.

In order to actively influence the running performance of the bogie 103 a first actuator 109 acts between the first wheel set 105 and the bogie frame 104, while a second actuator 110 acts between the second wheel set 106 and the bogie frame 104. For this purpose the respective actuator 109, 110 is linked on the one hand to the bogie frame 104 and on the other hand to one of the wheel bearing housings of the associated wheel set 105, 106.

The two actuators 109, 110 actively produce turning movements of the associated wheel set 105, 106 about a vertical axis, running perpendicularly to the drawing plane in FIG. 1, of the rail vehicle 101. The two actuators 109, 110 in other words actively influence the turning angle of the associated wheel set 105, 106 about a vertical axis, running perpendicularly to the drawing plane in FIG. 1, of the rail vehicle 101.

For this purpose the respective actuator 109, 110 produces a turning moment about the vertical axis of the rail vehicle 101 at the associated wheel set 105, 106. In the example shown having only one actuator 109, 110 for each wheel set 105, 106 the second component of the force couple on the respective wheel set 105, 106 is applied by the supporting force which acts on a corresponding coupling point (stops etc.) of the respective opposite wheel bearing housing on the bogie frame 104.

It goes without saying that, with other variants of the invention, several actuators can also be provided for each wheel set, as indicated in FIG. 1 by the broken lines 111, 112. The actuators 109, 110, for the sake of simplicity, are illustrated as linear actuators in FIG. 1. However, it goes without saying that other arbitrary linear or rotary actuators as well as other arbitrary linkages or transmissions can also be provided between the wheel sets and the bogie frame. A number of possible examples for this are found for example in DE 101 37 443 A1 cited at the beginning. Furthermore the actuators 109, 110 can be based on any working principle. Thus, hydromechanical, electromechanical working principles or arbitrary combinations thereof can be provided.

The bogie is controlled by a control unit 113 which is connected to the respective actuator 109, 110 and controls those accordingly in each case. Different variants of the control according to the invention can be pursued, which are described by way of example below.

It is common to all these variants that adjustment of the turning angle of the respective wheel set 105, 106 is provided, in a first frequency range, as a function of the actual curvature of the track and superimposed adjustment of the turning angle of the respective wheel set 105, 106, in a second frequency range, is provided such that transversal movements caused by track outlay disturbances or by a sinusoidal course are counteracted.

Thus, in other words, curve negotiation control takes place in the first frequency range while superimposed stability control takes place in the second frequency range. The first frequency range in this case ranges from 0 to 0.5 Hz, while the second frequency range ranges from 4 to 8 Hz. Thereby it is possible to optimize the performance of the bogie and thus the rail vehicle both on curved sections and also at high speeds on straight sections.

First Exemplary Embodiment

In a first preferred control variant according to the invention the curve negotiation control, i.e. adjustment of the turning angle of the first wheel set 105 in the first frequency range, is effected through the control unit 113 using a first target turning angle $\phi_{z1s}$ which corresponds to a first ideal target turning angle $\phi_{z1si}$ multiplied by a pre-defined first correction factor $K_1$, i.e. the following applies:

$$\phi_{z1s}=K_1\cdot\phi_{z1si}. \tag{11}$$

The first ideal target turning angle $\phi_{z1si}$ is selected such that, upon $K_1=1$, i.e. the first target turning angle $\phi_{z1s}$ matching the first ideal target turning angle $\phi_{z1si}$ at the actual curvature of the track, the first wheel set 105 is adjusted curve-radially.

Furthermore control takes place such that the first actuator 109, in the first frequency range, momentarily essentially does not have to apply any turning moment, i.e. $M_{Akt1}=0$ applies. As results from the moment balance according to equation (1), with the turning moments at the first wheel set 105 illustrated in FIG. 2, it thus applies that the resetting turning moment $M_{cxp1}$ of the first primary spring mechanism 107 is substantially in equilibrium with the turning moment $M_{Tx1}$ resulting from the wheel rail pairing on the first wheel set 105, as this is the case with a passive curve-friendly running gear, i.e. it applies that:

$$M_{Tx1}=-M_{cxp1}. \tag{2}$$

In other words, with this variant, when negotiating curves, it is permitted, in the first frequency range, that the first actuator 109 follows the excursion movement of the first wheel set 105 caused by the track curvature until, as with a passive curve-friendly running gear, the first wheel set 105 is adjusted at least approximately curve-radially.

When the first wheel set 105 is turned out from an actual position, intermittently or continuously, a new first ideal target turning angle $\phi_{z1si}$ is pre-defined for the first actuator 109, at which the freedom from load to be achieved is expected in view of the actual load on the first actuator 109. In other words, the first ideal target turning angle $\phi_{z1si}$ can be adjusted intermittently or continuously to follow the excursion movement and thus to follow the actual track curvature. Any quantity which is representative of the freedom from load of the actuator can be used as a guiding quantity for adjusting the first ideal target turning angle $\phi_{z1si}$. Thus this quantity is preferably selected as a function of the measurement principle with which the actuator load is determined.

Preferably the actual turning angle of the first wheel set 105 and a quantity representative of the actual load on the first actuator 109 are captured (for example a force value, a moment value, a pressure value, an electric current value etc.) by means of suitable sensors. Then a corresponding new first ideal target turning angle $\phi_{z1si}$ is pre-defined if the load on the first actuator 109 deviates from zero. This can take place intermittently or continuously, it being possible, for example, through temporal integration of the quantity representative of the load on the actuator 109 to guarantee that only the load situation on the actuator 109 in the first frequency range is captured.

As a result, measurement or other determination of the actual track curvature can be omitted, but it can be established, possibly only on the basis of the load on the first actuator 109 present in the first frequency range, that the wheel set is adjusted curve-radially, or conclusions can be drawn about the turning angle necessary for exact curve-radial adjustment on the basis of the parameters of the bogie 103 and the actual driving state (speed, transversal acceleration etc.). This has the advantage that, compared with a usually more or less complex calculation of the actual track curvature, a substantially shorter time delay in adjustment can be achieved.

By means of the first correction factor $K_1$ the first target turning angle $\phi_{z1s}$ used with the control in a defined way can be detuned relative to the first ideal target turning angle $\phi_{z1si}$. As a result, over- or under-compensation can also be achieved, which, however, is associated with energy consumption and results in $M_{Akt1}\neq 0$. For example, where $K_1=0$ applies, rigid wheel set guidance as in the case of the conventional passive vehicle can even be implemented.

Hereby it is possible in a defined way to detune the control relative to the ideal control using the first ideal target turning angle $\phi_{z1si}$, which is very prone to local wear on the wheels, without having to forfeit the advantages of the ideal control. It has turned out that with minor, defined deviations from the ideal control, with still good curve negotiating characteristics and good stabilization on straight sections, a substantially better distribution of the wear on the wheel contact surfaces can be achieved, resulting in a substantially more favourable wear pattern and, thus, longer service life.

In this case it can be provided that the ideal control is implemented possibly even over longer distances, i.e. the correction factor $K_1=1$ is selected, and only occasionally the control in a defined way is detuned relative to the ideal control, i.e. the relevant $K_1 \neq 1$ is selected. Furthermore, it can be provided that the detuning of the control relative to the ideal control by means of the correction factor $K_1$ is altered according to a pre-defined time scheme, for example, continuously. Likewise the correction factor $K_1$ naturally can also be varied as a function of the actual or expected running state (speed etc.) or the actual or expected track condition (track profile etc.). As a result, arbitrary wear distributions can be achieved.

The above-described control takes place in the case of the first control variant also for the second wheel set 106 of the bogie 103, so that with all wheel sets curve negotiating characteristics as with a passive curve-friendly running gear can be ultimately simulated. As is evident particularly from the above equation (1), the ideal concept of curve compliance with $M_{Tx}=0$ (i.e. without turning moment resulting from the wheel rail pairing) and with balanced curve-radial track transversal forces is not achieved with this control, but very good curve negotiating and wear characteristics can be achieved with high attainable track stability and very little energy consumption.

When running over a lateral disturbance of the track, the first wheel set 105 of the driving rail vehicle 101 experiences a certain lateral excursion of its centre from the mid track position as well as lateral acceleration resulting therefrom, which leads to a transversal speed of the first wheel set 105 relative to the track. In the case of corresponding profile combination of wheels and rails as a result of the rotational speed coupling of the two wheels sitting rigidly on the axial shaft joining them with weak damping, a sinusoidal transversal and turning movement of the wheel set 105—in the case of wheel sets 105, 106, as used here in the bogie 103, also of the entire running gear—would result around its mid position. This transversal and turning movement, at speeds above a stability limit, would increasingly be excited and lead to instability. The same applies for an ever increasing sinusoidal course resulting from a coincidental lateral initial excursion, which degenerates into unstable zigzag running. Such phenomena lead to increased transversal forces between wheels and rails, which can lead to intensified wear, even as far as shifting of the track bed or to danger of derailment.

In order to avoid this with the first control variant, stability of the first wheel set 105 is controlled on straight sections but also on curved sections, thus the turning angle of the first wheel set 105 is adjusted in the second frequency range by the control unit 113 using a second target turning angle $\phi_{z2si}$, which corresponds to a second ideal target turning angle $\phi_{z2si}$, multiplied by a pre-defined second correction factor $K_2$, i.e. the following applies:

$$\phi_{z2s}=K_2\cdot\phi_{zs2i}. \tag{12}$$

The second ideal target turning angle $\phi_{z2si}$ in this case is selected such that, where $K_2=1$ applies, i.e. if the second target turning angle $\phi_{z2s}$ matches the second ideal target turning angle $\phi_{z2si}$, transversal movements of the first wheel set 105 caused by track outlay disturbances or by a sinusoidal course are essentially compensated.

For this purpose it is provided that the momentary transversal speed of the first wheel set 105 as well as the momentary running speed of the rail vehicle 101 is determined. From the determined momentary transversal speed of the first wheel set 105 and the momentary running speed of the rail vehicle, a second ideal target turning angle $\phi_{z2si}$ is calculated for the second frequency range as the second ideal target value. In this case the second ideal target turning angle $\phi_{z2si}$ is selected such that, if the second desired turning angle representing the second target value matches the second ideal target turning angle (i.e. $K_2=1$), a transversal speed of the first wheel set 105 of the first wheel unit inversely equal to the determined transversal speed of the first wheel set 105 of the first wheel unit is produced. Thus, in other words, the resulting transversal speed of the first wheel set 105 of the wheel unit can be controlled to be zero.

On the other hand, with the method according to the invention, the momentary transversal speed of the wheel set $v_y$ is captured by suitable sensors, which for example are attached to the axle bearings. These may be, for example, laterally acting acceleration sensors the signals of which are integrated over time. In addition, the momentary running speed v of the rail vehicle which is taken for example from the superordinate train control system or by known speed recording instruments is fed to the control.

The aim of the ideal control ($K_2=1$) as mentioned is to impose an inversely equal transversal speed the first wheel set 105 with its transversal speed $v_y$ induced by the disturbance or sinusoidal course by means of the first actuator 109. This happens via a momentary second ideal target turning angle $\phi_{z2s}$, being constantly calculated as a guiding quantity, which during corresponding adjustment of the first wheel set 105 relative to its actual linkage, for example to the running gear frame, leads to the desired equally large, but inverse transversal speed $v_{yc}$ (see FIG. 3).

This calculated value of the ideal target turning angle $\phi_{z2si}$ is fed to the control unit 113 of the first actuator 109, which is capable of sufficiently high dynamics with sufficiently low phase shift. As a result of its action the transversal movement arising from the track outlay disturbance or the sinusoidal course is already eliminated on its onset so that the first wheel set 105, despite longitudinal soft guidance, remains at rest laterally and with respect to its turning movement.

The second wheel set 106 of the bogie 103 is likewise controlled according to this stability controlling method in order to keep it at rest laterally and with respect to its turning movement despite its longitudinal soft guidance.

Also during stability control, by means of the second correction factor ($K_2$) as described above for the curve-radial adjustment, again an arbitrary, possibly time-dependent detuning of the second target value used relative to the second ideal target value can be achieved. Thus, it is also possible for the stability control in a defined way to detune the control relative to the ideal control with the second ideal target turning angle $\phi_{z2si}$, which is very prone to local wear on the wheels, without having to forfeit the advantages of the ideal control. It turned out that with minor, defined deviations from the ideal control, still with good curve negotiating characteristics and good stabilization on straight sections, better distribution of the wear on the wheel contact surfaces can be achieved resulting in a substantially more favourable wear pattern and, thus, longer service life.

It can be provided that the ideal control is implemented possibly even over longer distances, i.e. the second correction factor is selected to be $K_2=1$, and only occasionally the control in a defined way is detuned relative to the ideal control, i.e. $K_2 \neq 1$ is selected. Furthermore, it can be provided that the detuning of the control relative to the ideal control by means of the correction factor $K_2$ is altered according to a pre-defined time scheme, for example, continuously. Likewise, the correction factor $K_2$ can naturally also be varied as a function of the actual or expected running state (speed etc.) or the actual or expected track condition (track profile etc.). As a result arbitrary wear distributions can be achieved.

Thus, with poor track quality, i.e. high amplitudes and large concentration of track outlay disturbances, or as a function of the running speed the parameterization of the control rules can be adapted. The automatic controller 113 can be adjusted for example in the case of poor track quality "more sharply", in order to react more quickly, or "more softly", for example, at low running speed, in order to prevent too heavy loading of the respective actuator 109, 110.

The stability controlling method has the advantage of great simplicity, since no time history must be recorded, but at each point in time only the momentary moving state of the first wheel set 105 is observed.

In addition each wheel set 105, 106 can be controlled independently of the other wheel set of the same running gear 103 or vehicle 101. Reactions to displacements of the track and possible instabilities are immediately eliminated on the wheel set 105, 106 by the control. The wheel set 105, 106 despite longitudinal soft wheel set guidance remains at rest, i.e. stable with respect to its movements in the transversal direction and about its vertical axis. Therefore no damping means are necessary against rotary movements about the vertical axis between wheel set 105, 106 and running gear 103 or between running gear 103 and carbody 102 or wheel set 105, 106 and carbody 102. Since, instead of damping of an instability the latter cannot even arise, the carbody 102 also behaves substantially more calmly than in the case of conventional solutions.

It has been shown that an improvement relative to the passively radially adjustable curve negotiation ($M_{Akt}=0$ and $M_{Tx}=-M_{cxp}$) as can be achieved with the first control variant described above, is only possible with considerable energy consumption at the respective actuator 109, 110 ($M_{Akt}>>0$), in order to approximate the ideal concept of curve negotiation (where $M_{Tx}=0$ and $\Sigma Y_1=\Sigma Y_2$). However, it is possible with the variants of the method according to the invention described below to achieve good approximation to ideal curve negotiation through correspondingly reduced energy consumption.

Second Exemplary Embodiment

Thus, with a preferred second control variant, it is provided that although the turning angle of the first wheel set 105 is likewise adjusted in accordance with the above first control variant (i.e. $M_{Akt1}=0$), the turning angle of the second wheel set 106 is adjusted in the first frequency range using a third target turning angle $\phi_{z3s}$ which corresponds to a third ideal target turning angle $\phi_{z3si}$ multiplied by a pre-defined third correction factor $K_3$. The third ideal target turning angle $\phi_{z3si}$ is selected such that, where $K_3=1$ applies, i.e. if the third target turning angle $\phi_{z3s}$ matches the third ideal target turning angle $\phi_{z3si}$, the turning moment $M_{TX1}$ on the first wheel set 105 resulting at the actual curvature of the track from the wheel rail pairing is inversely equal to the turning moment $M_{Tx2}$ on the second wheel unit resulting at the actual curvature of the track from the wheel rail pairing (i.e. $M_{Tx1}=-M_{Tx2}$).

From the above equations (3) to (6) the relations shown above are as follows:

$$\sum Y_1 = \frac{F_{aq}}{2} \pm \frac{M_{cxs}}{2a}, \tag{7}$$

-continued $$\sum Y_2 = \frac{F_{aq}}{2} \mp \frac{M_{cxs}}{2a}. \tag{8}$$

In other words it is hereby achieved that the sums of the lateral track forces $\Sigma Y_1$ on the first wheel set 105 and $\Sigma Y_2$ on the second wheel set 106 are balanced apart from the component of the resetting turning moment $M_{cxs}$ of the secondary spring mechanism 114 by means of which the carbody 102 is supported on the bogie frame 104.

The control unit 113 computes the third ideal target turning angle $\phi_{z3si}$ preferably from the turning moment $M_{Tx1}$ on the first wheel set 105 resulting at the actual curvature of the track from the wheel rail pairing, a dependence specific to the bogie 103 of the turning moment $M_{cxp2}$ of the second primary spring mechanism 108 on the turning angle $\phi_{z3}$ of the second wheel set 106, and a dependence specific to the bogie 103 of the turning moment $M_{Akt2}$ of the second actuator 110 on the turning angle $\phi_{z3}$ of the second wheel set 106. Such a dependence of the turning moment $M_{Akt2}$ of the second actuator 110 on the turning angle $\phi_{z3}$ of the second wheel set 106 can be pre-defined in an arbitrary way, for example, by an equation, a characteristic line or characteristic map etc., which has been determined in advance for the bogie 103 or the vehicle 101.

Here again, an arbitrary, possibly time-dependent, driving-situation-dependent and/or track-situation-dependent detuning of the third target turning angle $\phi_{z3si}$ used relative to the third ideal target turning angle $\phi_{z3si}$ can be achieved by means of the third correction factor $K_3$, in the same way as already described above in connection with the first correction factor $K_1$. Thus the third correction factor $K_3$, similar to the first correction factor $K_1$, at least occasionally can be selected unequal to one and/or at least occasionally selected equal to one and/or varied according to a pre-defined scheme.

In order to avoid unstable running states, as in the case of the first control variant, a stability control of the wheel sets 105, 106 on straight sections but also on curved sections takes place, i.e. the turning angle of the first and second wheel set 105, 106 is adjusted in the second frequency range. The control unit 113 here functions as described above in connection with the first control variant, i.e. using a second target turning angle $\phi_{z2s}$ which corresponds to a second ideal target turning angle $\phi_{z2si}$ multiplied by a pre-defined second correction factor $K_2$. Therefore, reference should only be made here to the above explanations.

Third Exemplary Embodiment

In a preferred third control variant the curve negotiation control, i.e. the adjustment of the turning angle of the first wheel set 105 in the first frequency range, is effected via the control unit 113 using a first target turning angle $\phi_{z1s}$ which in turn corresponds to the first ideal target turning angle $\phi_{z1si}$ multiplied by a pre-defined first correction factor $K_1$, i.e. the following also applies here:

$$\phi_{s1s}=K_1\cdot\phi_{z1si}. \tag{11}$$

In this case it is provided that the first actuator 109 is adjusted to follow, in the first frequency range, a turning movement of the first wheel unit caused by a change in the curvature of the track such that the first actuator 109, where $K_1=1$ applies, i.e. where the first target turning angle $\phi_{z1s}$ matches the first ideal target turning angle $\theta_{z1si}$ at the actual curvature of the track, in the first frequency range momentarily applies a turning moment $M_{Akt1}$ which is inversely equal to the turning moment $M_{cxp1}$ of the first primary spring mechanism 107 (i.e. $M_{Akt1}=-M_{cxp1}$).

The second wheel set 106 is likewise controlled according to this method. The turning angle of the second wheel set 106, in the first frequency range, is therefore adjusted using a third target turning angle $\phi_{z3s}$ which corresponds to a third ideal target turning angle $\phi_{z3si}$ multiplied by a pre-defined third correction factor $K_3$. The third ideal target turning angle $\phi_{z3si}$ is again selected such that, where $K_3=1$ applies, i.e. where the third target turning angle $\phi_{z3s}$ matches the third ideal target turning angle $\phi_{z3si}$ the second actuator 110 is adjusted in the first frequency range to follow a turning movement of the second wheel unit caused by a change in the curvature of the track such that the second actuator 110 at the actual curvature of the track, in the first frequency range, momentarily applies a turning moment $M_{Akt2}$ which is inversely equal to the turning moment $M_{cxp2}$ of the first primary spring mechanism 108 (i.e. $M_{Akt2}=-M_{cxp2}$).

Here disappearance of the turning moment from the wheel rail pairing (i.e. $M_{Tx1}=M_{Tx2}=0$) results from equation (1), i.e. when the first wheel set 105 and the second wheel set 106 are adjusted curve-radially, and in turn from the equations (3) to (6) it applies:

$$\sum Y_1 = \frac{F_{aq}}{2} \pm \frac{M_{cxs}}{2a}, \tag{7}$$

$$\sum Y_2 = \frac{F_{aq}}{2} \mp \frac{M_{cxs}}{2a}. \tag{8}$$

In other words, hereby as well it is achieved—as with the second control variant—that the sums of the lateral track forces $\Sigma Y_1$ on the first wheel set 105 and $\Sigma Y_2$ on the second wheel set 106 are balanced apart from the component of the resetting turning moment $M_{cxs}$ of the secondary spring mechanism 114.

The first ideal target turning angle $\phi_{z1si}$ or the third ideal target turning angle $\phi_{z3si}$ can be adjusted to the curvature of the track in any arbitrary suitable way. Preferably, the actual turning angle $\phi_{z1}$ of the first wheel set 105 or the actual turning angle $\phi_{z3}$ of the second wheel set 106 and a quantity representative of the load on the respective actuator 109, 110 (for example a force value, a moment value, a pressure value, an electric current value etc.) can be captured. A new first ideal target turning angle $\phi_{z1si}$ or a new third ideal target turning angle $\phi_{z3si}$ is defined if the load on the actuator 109, 110 concerned deviates from the one which in the case of this turning angle $\phi_{21}$ or $\phi_{23}$ would result from the resetting moment of the primary spring mechanism 107 or 108.

Also here again an arbitrary, possibly time-dependent, driving-situation-dependent and/or track-situation-dependent detuning of the first or third target value used relative to the first or third ideal target value can be achieved by means of the first correction factor $K_1$ or third correction factor $K_3$ as described above. Thus the first correction factor $K_1$ or the third correction factor $K_3$, respectively, at least occasionally can be selected unequal to one and/or at least occasionally selected equal to one and/or varied according to a pre-defined scheme.

In order to avoid unstable running states, as in the case of the first control variant the stability of the wheel sets 105, 106 is controlled on straight sections but also on curved sections, i.e. the turning angle of the first and second wheel set 105, 106 is adjusted in the second frequency range. The control unit 113 here functions as described above in connection with the first control variant, i.e., using a second target turning angle $\phi_{z2s}$ which corresponds to a second ideal target turning angle $\phi_{z2si}$ multiplied by a pre-defined second correction factor $K_2$. Therefore, reference should only be made here to the above explanations.

Fourth Exemplary Embodiment

In a preferred fourth control variant the curve negotiation control, i.e. the adjustment of the turning angle of the first wheel set 105 in the first frequency range, takes place as in the case of the first control variant (i.e. $M_{Akt1}=0$). The turning angle of the second wheel set 106 however is adjusted in the first frequency range using a third target turning angle $\phi_{z3s}$ which corresponds to a third ideal target turning angle $\phi_{z3si}$ multiplied by a pre-defined third correction factor $K_3$. The third ideal target turning angle $\phi_{z3si}$ is selected such that, where $K_3=1$ applies, i.e. where the third target turning angle $\phi_{z3s}$ matches the third ideal target turning angle $\phi_{z3si}$, the turning moment $M_{Tx2}$ on the second wheel set 106 resulting at the actual curvature of the track from the wheel rail pairing corresponds to the turning moment difference, which results from the product of a travel direction factor L with the actual resetting turning moment $M_{cxs}$ present from the secondary spring mechanism 108 and a turning moment $M_{Tx1}$ on the first wheel set 105 resulting at the actual curvature of the track from the wheel rail pairing. The travel direction factor L for a leading bogie 103 in the travel direction is equal to 1 and for a trailing bogie 103 is equal to −1 (i.e. $M_{Tx2}=M_{cxs}-M_{Tx1}$ for a leading bogie 103 and/or $M_{Tx2}=-M_{cxs}-M_{Tx1}$ for a trailing bogie 103).

In the case of this fourth control variant ($M_{Akt1}=0$ and $M_{Tx2}=\pm M_{cxs}-M_{Tx1}$) the relationship here results from the equations (3) to (6):

$$\sum Y_1 = \frac{F_{aq}}{2} \pm \frac{M_{cxs}}{2a} \mp \frac{M_{cxs}}{2a} = \frac{F_{aq}}{2}, \tag{9}$$

$$\sum Y_2 = \frac{F_{aq}}{2} \mp \frac{M_{cxs}}{2a} \pm \frac{M_{cxs}}{2a} = \frac{F_{aq}}{2}. \tag{10}$$

In other words it is hereby achieved that the sums of the lateral track forces $\Sigma Y_1$ on the first wheel set 105 and $\Sigma Y_2$ on the second wheel set 106 are balanced (i.e. $\Sigma Y_1=\Sigma Y_2$).

In order to determine the resetting turning moment $M_{cxs}$ from the secondary spring mechanism 108, the turning angle between the bogie frame 104 and the carbody 102 is determined by means of a sensor 115 connected to the control unit 113.

Also here an arbitrary, possibly time-dependent, driving-situation-dependent and/or track-situation-dependent detuning of the first or third target value used, respectively, relative to the first or third ideal target value can be achieved by means of the first correction factor $K_1$ or the third correction factor $K_3$, respectively, as described above. Thus, the first correction factor $K_1$ or the third correction factor $K_3$ at least occasionally can be selected unequal to one and/or at least occasionally selected equal to one and/or varied according to a pre-defined scheme.

In order to avoid unstable running states, as in the case of the first control variant, stability of the wheel sets 105, 106 is controlled on straight sections but also on curved sections, i.e. the turning angle of the first and second wheel set 105, 106 is adjusted in the second frequency range. The control unit 113 here functions as described above in connection with the first control variant, i.e. using a second target turning angle $\phi_{z2s}$ which corresponds to a second ideal target turning angle $\phi_{z2si}$ multiplied by a pre-defined second correction factor $K_2$. Therefore reference should be made here only to the above explanations.

Fifth Exemplary Embodiment

In a preferred fifth control variant, curve negotiation control, i.e. the adjustment of the turning angle of the first wheel set 105 in the first frequency range, takes place as in the case of the third control variant (i.e. $M_{Akt1}=-M_{cxp1}$). The turning angle of the second wheel set 106 however is adjusted in the first frequency range as in the case of the fourth control variant (i.e. $M_{Tx2}=M_{cxs}-M_{Tx1}$ for a leading bogie 103 or $M_{Tx2}=-M_{cxs}-M_{Tx1}$ for a trailing bogie 103, respectively). In this connection therefore reference shall only be made to the above explanation.

In the case of this fifth control variant and in the case of the fifth variant ($M_{Akt1}=-M_{cxp1}$ and $M_{Tx2}=\pm M_{cxs}-M_{Tx1}$) the relationship here results from equations (3) to (6):

$$\sum Y_1 = \frac{F_{aq}}{2} \pm \frac{M_{cxs}}{2a} \mp \frac{M_{cxs}}{2a} = \frac{F_{aq}}{2}, \tag{9}$$

$$\sum Y_2 = \frac{F_{aq}}{2} \mp \frac{M_{cxs}}{2a} \pm \frac{M_{cxs}}{2a} = \frac{F_{aq}}{2}. \tag{10}$$

In other words it is also hereby achieved that the sums of the lateral track forces $\Sigma Y_1$ on the first wheel set 105 and $\Sigma Y_2$ on the second wheel set 106 are balanced (i.e. $\Sigma Y_1=\Sigma Y_2$).

Also here an arbitrary, possibly time-dependent, driving-situation-dependent and/or track-situation-dependent detuning of the first or third target value used relative to the first or third ideal target value, respectively, can be achieved by means of the first correction factor $K_1$ or the third correction factor $K_3$ as described above. Thus, the first correction factor K and/or the third correction factor $K_3$ at least occasionally can be selected unequal to one and/or at least occasionally selected equal to one and/or varied according to a pre-defined scheme.

In order to avoid unstable running states, as in the case of the first control variant stability of the wheel sets 105, 106 is controlled on straight sections but also on curved sections, i.e. the turning angle of the first and second wheel set 105, 106 is adjusted in the second frequency range. The control unit 113 functions here as described above in connection with the first control variant, i.e. using a second target turning angle $\phi_{z2s}$, which corresponds to a second ideal target turning angle $\phi_{z2si}$ multiplied by a pre-defined second correction factor $K_2$. Therefore, reference should here only be made to the above explanations.

It goes without saying that with all the above-described control variants driving and braking moments influence the action of the curvature control especially in the case of the asymmetrical solution illustrated in FIG. 1. They produce a force on the respective actuator rod, which causes the respective wheel set to turn out—equivalent to a negotiating curve. The driving and braking moments however can be superimposed over the controller loop and therefore balanced via appropriate measurement (for example rod force measurement on the non-actuator side) or by transmission from the train control system.

The present invention has been described above exclusively on the basis of examples with ideal target turning angles as ideal target values. It goes without saying however that, with other variants of the invention, any other suitable quantity by means of which the desired adjustment of the wheel set concerned can be achieved may also be used as the ideal target value.

The present invention has been described above exclusively on the basis of examples with bogies having two wheel sets. It goes without saying however that, in the case of other variants of the invention, any arbitrary other running gear type can also be used.

The invention claimed is:

1. A method for controlling an active running gear of a rail vehicle comprising: at least one first wheel unit with two wheels, wherein a turning angle of the first wheel unit is adjusted by means of at least one first actuator acting between the first wheel unit and a vehicle structure supported thereon by means of a first primary spring mechanism, the method comprising the steps of:

adjusting the turning angle of the first wheel unit about a vertical running gear axis relative to the vehicle structure in a first frequency range as a function of an actual curvature of a track and adjusting the turning angle of the first wheel unit about a vertical running gear axis relative to the vehicle structure in a second frequency range such that transversal movements at least of the first wheel unit caused by track outlay disturbances or by a sinusoidal course are counteracted, wherein the turning angle of the first wheel unit is adjusted in the first frequency range using a first target value, which corresponds to a first ideal target value multiplied by a pre-defined first correction factor, wherein the first ideal target value is selected such that, if the first target value matches the first ideal target value at the actual curvature of the track, the first wheel unit is adjusted at least approximately curve-radially, and the turning angle of the first wheel unit is adjusted in the second frequency range using a second target value, which corresponds to a second ideal target value multiplied by a pre-defined second correction factor, wherein the second ideal target value is selected such that, if the second target value matches the second ideal target value, transversal movements at least of the first wheel unit caused by track outlay disturbances or by a sinusoidal course are essentially compensated.

2. The method of claim 1, wherein if the first target value matches the first ideal target value at the actual curvature of the track, the first wheel unit is adjusted exactly curve-radially; and the resetting turning moment of the first primary spring mechanism is essentially in equilibrium with the turning moment resulting from the wheel rail pairing, so that the at least one first actuator momentarily essentially must not apply any turning moment.

3. The method of claim 1, wherein the at least one first actuator is adjusted in the first frequency range to follow a turning movement of the first wheel unit caused by a change in the curvature of the track such that, if the first target value matches the first ideal target value at the actual curvature of the track, the at least one first actuator momentarily in the first frequency range essentially does not apply any turning moment.

4. The method of claim 1, wherein the first ideal target value is a first ideal target turning angle which is adjusted to follow the curvature of the track.

5. The method of claim 1, wherein the first correction factor
at least occasionally is selected unequal to one
and/or
at least occasionally is selected equal to one
and/or
is varied according to a pre-defined scheme.

6. The method of claim 1, wherein
the running gear comprises a second wheel unit with two wheels trailing the first wheel unit on which the vehicle structure is supported by means of a second primary spring mechanism,
the turning angle of the second wheel unit is adjusted by means of at least one second actuator acting between the second wheel unit and the vehicle structure, and
the turning angle of the second wheel unit is adjusted in the first frequency range using a target value, which corresponds to a third ideal target value multiplied by a pre-defined third correction factor, wherein
the third ideal target value is selected such that, if the third target value matches the third ideal target value at the actual curvature of the track, the turning moment on the first wheel unit resulting from the wheel rail pairing is inversely equal to the turning moment on the second wheel unit resulting at the actual curvature of the track from the wheel rail pairing.

7. The method of claim 6, wherein the third ideal target value is a third ideal target turning angle, which is calculated from
the turning moment on the first wheel unit resulting at the actual curvature of the track from the wheel rail pairing,
a dependence, pre-defined for the running gear, of the turning moment of the second primary spring mechanism on the turning angle of the second wheel unit and
a dependence, pre-defined for the running gear, of the turning moment of the second actuator on the turning angle of the second wheel unit.

8. The method of claim 6, wherein the third correction factor
at least occasionally is selected unequal to one
and/or
at least occasionally is selected equal to one
and/or
is varied according to a pre-defined scheme.

9. The method of claim 1, wherein the at least one first actuator is adjusted, in the first frequency range, to follow a turning movement of the first wheel unit caused by a change in the curvature of the track such that, if the first target value matches the first ideal target value at the actual curvature of the track, the at least one first actuator momentarily in the first frequency range applies a turning moment which is inversely equal to the turning moment of the first primary spring mechanism.

10. The method of claim 9, wherein the first ideal target value is a first ideal target turning angle which is adjusted to the curvature of the track.

11. The method of claim 9, wherein the first correction factor
at least occasionally is selected unequal to one
and/or
at least occasionally is selected equal to one
and/or
is varied according to a pre-defined scheme.

12. The method of claim 9, wherein
the running gear comprises a second wheel unit with two wheels trailing the first wheel unit on which the vehicle structure is supported by means of a second primary spring mechanism,
the turning angle of the second wheel unit is adjusted by means of at least one second actuator acting between the second wheel unit and the vehicle structure, and
the turning angle of the second wheel unit is adjusted in the first frequency range using a third target value which corresponds to a third ideal target value multiplied by a pre-defined third correction factor, wherein
the third ideal target value is selected such that, if the third target value matches the third ideal target value, the at least one second actuator is adjusted, in the first frequency range, to follow a turning movement of the second wheel unit caused by a change in the curvature of the track such that the at least one second actuator at the actual curvature of the track momentarily, in the first frequency range, applies a turning moment which is inversely equal to the turning moment of the second primary spring mechanism.

13. The method of claim 6, wherein the third ideal target value is a third ideal target turning angle which is adjusted to follow the curvature of the track.

14. The method of claim 12, wherein the first correction factor
at least occasionally is selected unequal to one
and/or
at least occasionally is selected equal to one
and/or
is varied according to a pre-defined scheme.

15. The method of claim 9, wherein
the running gear comprises a second wheel unit with two wheels trailing the first wheel unit on which the vehicle structure is supported by means of a second primary spring mechanism,
the turning angle of the second wheel unit is adjusted by means of at least one second actuator acting between the second wheel unit and the vehicle structure,
the vehicle structure is supported by means of a primary spring mechanism and a secondary spring mechanism on the first wheel unit and the second wheel unit and
the turning angle of the second wheel unit is adjusted in the first frequency range using a third target value which corresponds to a third ideal target value multiplied by a pre-defined third correction factor, wherein
the third ideal target value is selected such that, if the third target value matches the third ideal target value, the turning moment on the second wheel unit resulting at the actual curvature of the track from the wheel rail pairing corresponds to the turning moment difference, which results from the product of a travel direction factor with the actual resetting turning moment present from the secondary spring mechanism and the amount of the turning moment on the first wheel unit resulting at the actual curvature of the track from the wheel rail pairing, wherein
the travel direction factor for a leading running gear is equal to 1 and for a trailing running gear is equal to −1.

16. The method of claim 15, wherein
the running gear comprises a running gear frame, which is supported on the first wheel unit and the second wheel unit in each case by a primary spring mechanism,
the vehicle structure is supported on the running gear frame by means of the secondary spring mechanism, and
in order to determine the resetting turning moment from the secondary spring mechanism, the turning angle between the running gear frame and the vehicle structure is determined.

17. The method of claim 15, wherein the third ideal target value is a third ideal target turning angle which is adjusted to follow the curvature of the track.

18. The method of claim 15, wherein the third correction factor at least occasionally is selected unequal to one and/or at least occasionally is selected equal to one and/or is varied according to a pre-defined scheme.

19. The method of claim 1, wherein the first frequency range comprises 0 to 1 Hz.

20. The method of claim 1, wherein the second frequency range lies at least partly above the first frequency range.

21. The method of claim 20, wherein the second frequency range comprises 4 to 8 Hz.

22. The method of claim 1, further comprising the steps of determining a momentary transversal speed of the first wheel unit as well as a momentary running speed of the rail vehicle and calculating a second ideal target turning angle from the determined momentary transversal speed of the first wheel unit and the momentary running speed of the rail vehicle for the second frequency range as the second ideal target value, wherein the second ideal target turning angle is calculated such that, if a second target turning angle representing the second target value matches the second ideal target turning angle, a transversal speed of the first wheel unit inversely equal to a calculated transversal speed of the first wheel unit is produced.

23. The method of claim 22, wherein the momentary transversal speed of the first wheel unit is captured by means of a speed sensor or a momentary transversal acceleration of the first wheel unit captured by an acceleration sensor is integrated to provide the momentary transversal speed of the first wheel unit, and/or a running speed supplied by a superordinate train control system is used as the momentary running speed of the rail vehicle, and/or the momentary running speed of the rail vehicle is determined by measuring the rotational speed of at least one wheel of the rail vehicle.

24. The method of claim 1, wherein the second correction factor at least occasionally is selected unequal to one and/or at least occasionally is selected equal to one and/or is varied according to a pre-defined scheme.

25. A device for controlling an active running gear of a rail vehicle having:

at least one first wheel unit with two wheels comprising a control unit and at least one first actuator controlled by the control unit and acting between the first wheel unit and a vehicle structure supported thereon by means of a first primary spring mechanism, wherein the control unit by means of the at least one first actuator, in a first frequency range, adjusts a turning angle of the first wheel unit about a vertical running gear axis relative to the vehicle structure as a function of a actual curvature of a track, and the control unit by means of the at least one first actuator, in a second frequency range, counteracts transversal movements at least of the first wheel unit caused by track outlay disturbances or by a sinusoidal course, wherein the control unit is configured such that the turning angle of the first wheel unit is adjusted in the first frequency range using a first target value which corresponds to a first ideal target value multiplied by a pre-defined first correction factor, wherein the first ideal target value is selected such that, if the first target value matches the first ideal target value at the actual curvature of the track, the first wheel unit at least approximately is adjusted curve-radially, and the control unit is configured such that the turning angle of the first wheel unit is adjusted in the second frequency range using a second target value which corresponds to a second ideal target value multiplied by a pre-defined second correction factor, wherein the second ideal target value is selected such that, if the second target value matches the second ideal target value, transversal movements of at least the first wheel unit caused by track outlay disturbances or by a sinusoidal course are essentially compensated.

26. The device of claim 25, wherein the first ideal target value is a first ideal target turning angle and the control unit adjusts the first ideal target turning angle to follow the curvature of the track, and/or the second ideal target value is a second ideal target turning angle.

27. The device according to claim 25, wherein the second frequency range at least partly lies above the first frequency range.

28. A rail vehicle with an active running gear comprising a device for controlling the active running gear according to claim 25.

* * * * *